US005244391A

United States Patent [19]

Bryant

[11] Patent Number: 5,244,391

[45] Date of Patent: Sep. 14, 1993

[54] EDUCATIONAL BOARD GAME

[76] Inventor: John E. Bryant, P.O. Box 308, Halifax, N.C. 27839

[21] Appl. No.: 880,154

[22] Filed: May 5, 1992

[51] Int. Cl.[5] ..... G09B 19/22; A63F 3/00

[52] U.S. Cl. ..... 434/129; 434/128; 273/243

[58] Field of Search ..... 434/128, 129; 273/243, 273/248

[56] References Cited

U.S. PATENT DOCUMENTS

| | | | |
|---|---|---|---|
| 4,216,966 | 8/1980 | MacRae | 273/243 |
| 4,273,337 | 6/1981 | Carrera et al. | 273/243 |
| 4,878,675 | 11/1989 | Perry et al. | 273/251 |
| 4,986,757 | 1/1991 | Mueller | 434/127 |
| 5,104,127 | 4/1992 | Whitney | 273/243 |

*Primary Examiner*—Gene Mancene
*Assistant Examiner*—Cindy A. Cherichetti
*Attorney, Agent, or Firm*—S. Michael Bender

[57] ABSTRACT

An educational board game relating to the subject of illegal chemical substances (e.g. narcotics or "drugs") comprising a game board, player tokens, question cards and fact cards. The board includes a track or path of spaces along which the tokens are moved in response to manipulation of a chance means. The fact cards or the question cards are read aloud to all players depending upon which spaces on the track the individual tokens land on. The object of the game is to gain knowledge about the dangers of illegal drug use as the individual player tokens progress along the track.

10 Claims, 4 Drawing Sheets

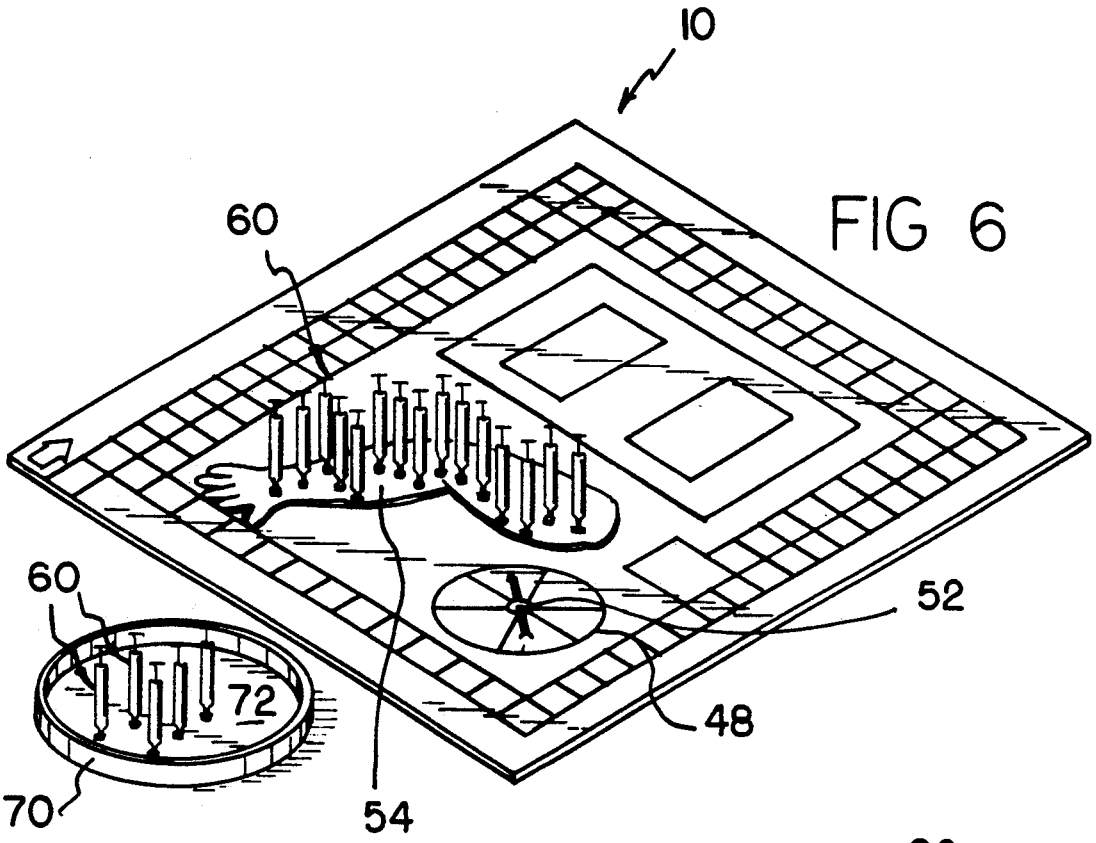
FIG 6
FIG 7
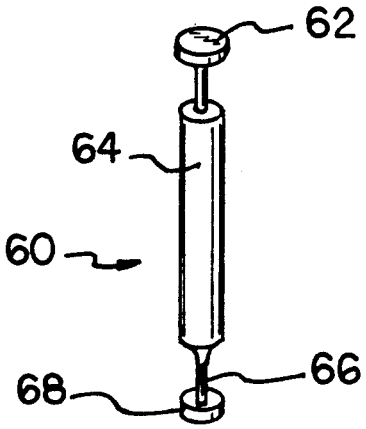
FIG 8

EDUCATIONAL BOARD GAME

BACKGROUND OF THE INVENTION

1. Field of the Invention

The present invention relates generally to amusement devices and more particularly, to an educational board game adapted to teach the playing public about the dangers of using illegal chemical substances (e.g. narcotics or "drugs").

2. Description of the Prior Art

Educational board games have become enormously popular because they combine the passing of an enjoyable leisure activity with the acquisition of knowledge. The theme or subject of an educational board game may relate to a wide range of different categories such as the well known question and answer board game sold under the registered trademark TRIVIAL PURSUIT, or to a single category such as "real estate" as treated, for example, in the well known board game sold under the registered trademark MONOPOLY.

A need definitely exists in today's society to educate the populace against the hazards associated with the use and/or addiction of illegal drugs, narcotics or other chemical substances. Hence, an amusement device in the form of an educational board game whose object is to inform the players about the dangers of drug abuse clearly would be beneficial. A prior art search has uncovered U.S. Pat. No. 4,878,675 which describes a board game having question cards related to the use of addictive substances such as alcohol, for example, and the hazards associated therewith, e.g. driving while intoxicated offenses. Under the rules of this patented game, player tokens are moved along a path on the board whose spaces are correlated to the cards in a conventional 52 card playing deck. The spaces in turn, are associated with question and answer cards. If the player answers the question correctly, a token may be placed on an ancillary card in a space correlated to the suit of the playing card space on the board. The object is to complete a row of tokens on the ancillary card ahead of all other players. While this game does address the subject of chemical substance abuse, its value as an educational tool is somewhat limited. Moreover, it is relatively complicated and features an unusually large number of parts.

Other game board devices are known which address various other aspects of human experience. For example, U.S. Pat. No. 4,714,255 relates to a question and answer board game devoted to the subject of criminal justice. Movement of game tokens along the tracks on the game board is determined by correctly answering questions involving famous crimes, gangsters, etc.

U.S. Pat. No. 4,907,808 relates to a question and answer board wherein the questions are based upon trivia associated with the T.V. show or movie known as STAR TREK. Progress in answering the questions is noted by movement across a board to reach certain imagined destinations and the construction of a model of the starship ENTERPRISE from various pieces awarded as each question correctly is answered.

U.S. Pat. No. 4,736,954 relates to a question and answer game wherein the answers to posed questions about "geography" have associated therewith "reference codes." The correct answers are determined by correlating the codes on a surface representation (e.g. a map) having subdivisions matching the codes by viewing through optical means. Categories and/or difficulty of question are selected by chance using a six-sided die, for example.

U.S. Pat. No. 4,856,780 relates to a question and answer board game wherein the questions are devoted to basketball trivia. Movement of player tokens along the game board is determined by a throw of dice and the squares on the board determine point value and difficulty of posed questions contained on cards. Correctly answering a question yields one point as in a "foul shot" or 2 or 3 points as when a goal is scored from the field.

SUMMARY OF THE INVENTION

Against the foregoing background of known prior art it is apparent that a new and improved educational board game devoted to teaching the hazards of illegal drug abuse would be advantageous. The present invention provides such an educational board game which, briefly described, comprises a game board, a plurality of individual player tokens movable upon a path on the board, chance means to determine the extent of movement of the player tokens, and two different stacks of cards, a FACT card and a QUESTION card, disposed in their respective designated zones on the board. In its most elementary form, movement of the individual player tokens on the board path determines which card, i.e. FACT or QUESTION, will be drawn by that player. If a FACT card is drawn, the player reads the indicia on the card to the other players; whereas if a QUESTION card is drawn, the player attempts to answer the question displayed on the card by giving his or her own personal opinion regarding the answer. Discussion could then be had among all players with respect to the facts read from the FACT cards, or the questions, answers and/or opinions provoked by the QUESTION cards.

In an alternative embodiment, the game board is provided with a representation of a human arm and with game pieces in the shape and configuration of hypodermic syringes. The game pieces are associated with each question and when a QUESTION card is correctly answered by a player the corresponding hypodermic syringe game piece is removed from the board and a "correct answer" token emplaced in the position of the removed game piece. The object of the game in this alternative form is to remove as many hypodermic syringes as possible from the game board symbolizing the overcoming of a substance abuse habit.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least two embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which only is measured by the claims, nor is it intended to be limiting as to the scope of the invention in any way.

It is therefore an object of the present invention to provide a new and improved educational board game which has all the advantages of the prior art and none of the disadvantages thereof.

It is another object of the present invention to provide a new and improved educational board game which may be easily and efficiently manufactured and marketed.

It is a further object of the present invention to provide a new and improved educational board game which is of a durable and reliable construction.

An even further object of the present invention is to provide a new and improved educational board game which is susceptible of a low cost of manufacture with regard to both materials and labor, and which accordingly is then susceptible of low prices of sale to the consuming public, thereby making the present invention economically available to the buying public.

Still yet another object of the present invention is to provide a new and improved educational board game which provides in the apparatuses and methods of the prior art some of the advantages thereof, while simultaneously overcoming some of the disadvantages normally associated therewith.

Still another object of the present invention is to provide a new and improved educational board game that is enjoyable to play and at the same time imparts knowledge of the hazards of illegal chemical substance use to the players thereof.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had now to the accompanying drawings and descriptive matter in which there are illustrated preferred embodiments of the invention.

BRIEF DESCRIPTION OF THE DRAWINGS

The invention will be better understood and the above objects as well as objects other than those set forth above, will become apparent when consideration is given to the following detailed description thereof. Such description makes reference to the annexed drawings wherein:

FIG. 6 is a perspective view of an alternative preferred form of game board according to the present invention.

FIG. 7 is a perspective view of a tray used to store game pieces of the embodiment of FIG. 6.

FIG. 8 is a perspective view of a game piece used with the embodiment of FIG. 6.

DESCRIPTION OF THE PREFERRED EMBODIMENT

Figure 1:
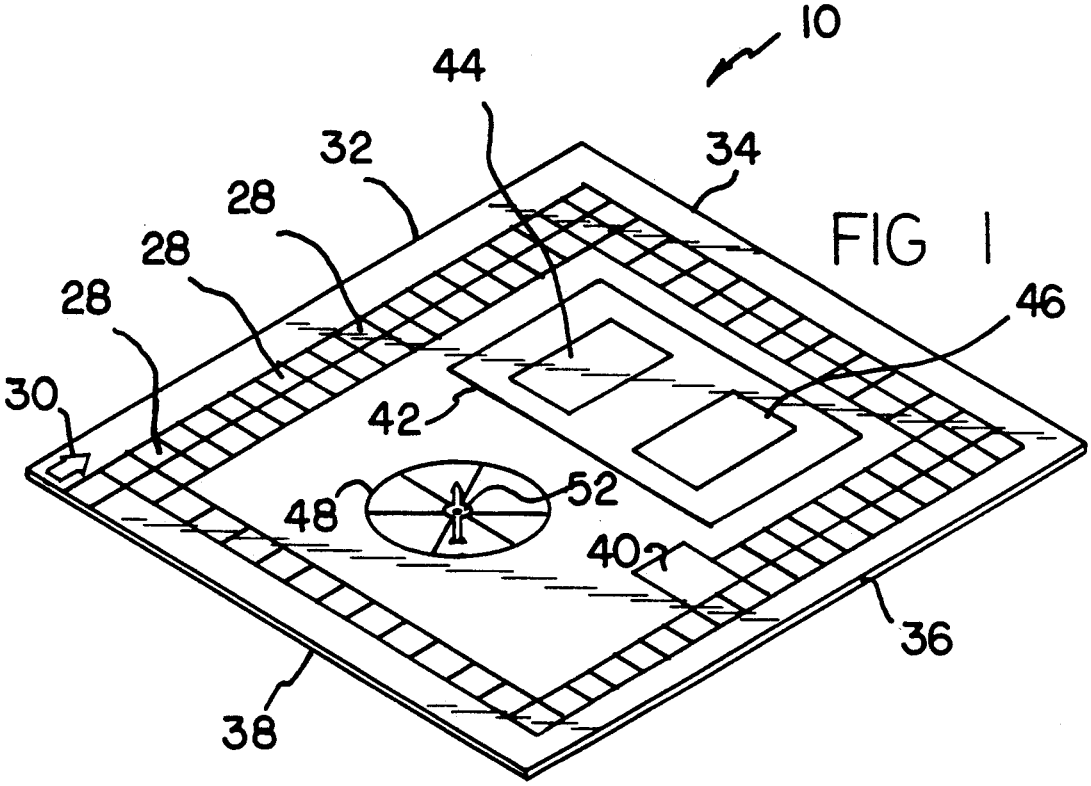
FIG. 1 is a perspective view of a first preferred form of a game board according to the present invention.
Figure 3:
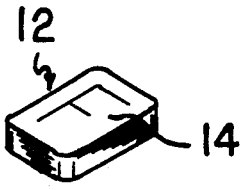
FIG. 3 is a perspective view of the FACT card deck of the present invention.
Figure 2:
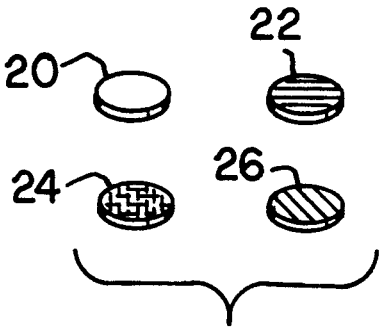
FIG. 2 is a perspective view of the individual player tokens used with the embodiment of FIG. 1.
Figure 4:
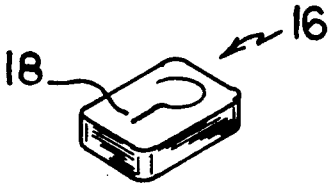
FIG. 4 is a perspective view of the QUESTION card deck of the present invention.
Figure 5:
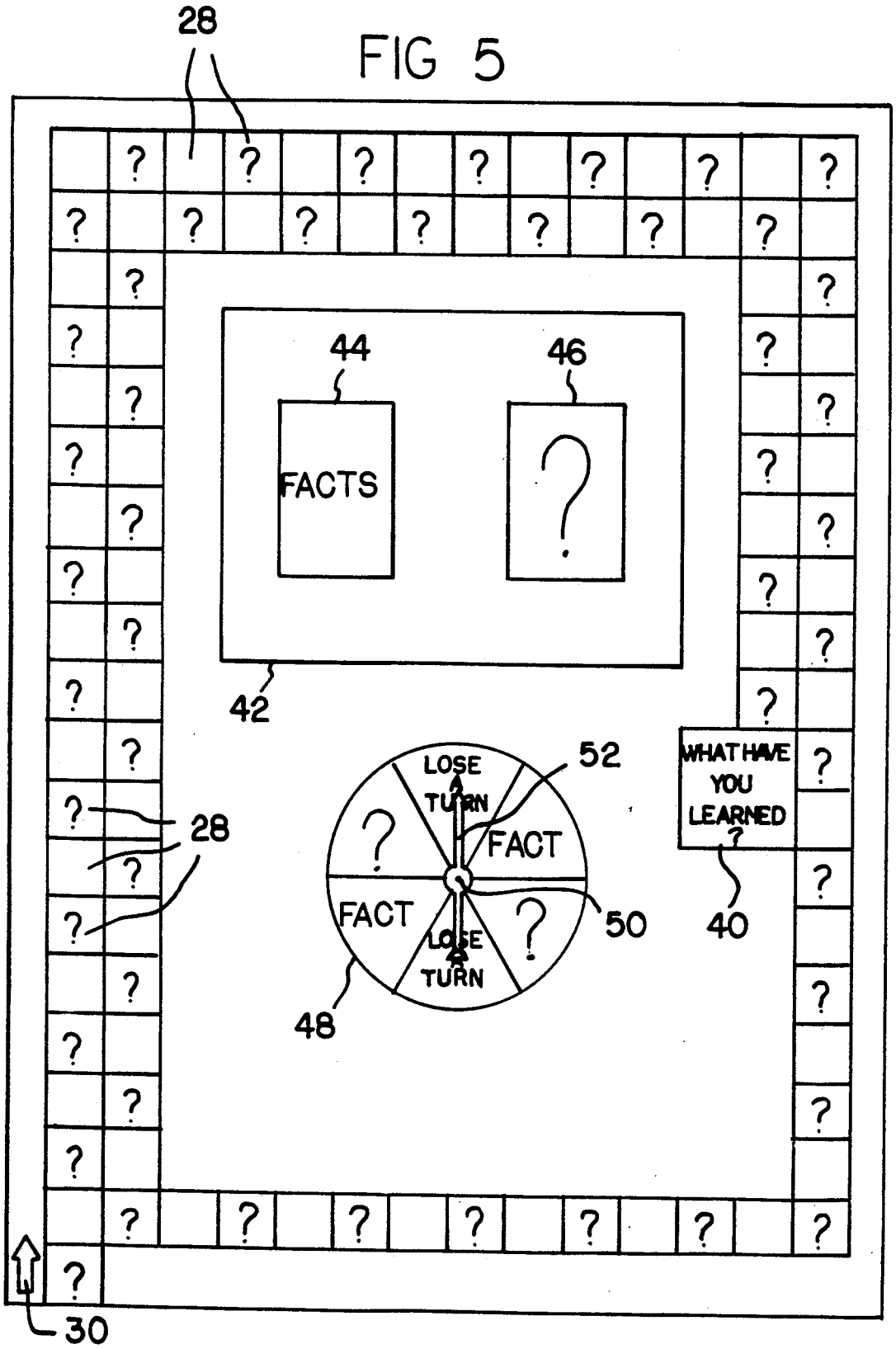
FIG. 5 is a plan view of the layout of the game board of FIG. 1.

With reference now to the drawings, a new and improved educational board game embodying the principles and concepts of the present invention will be described.

Turning initially to FIGS. 1 through 5, there is shown a first preferred form of the present invention comprising a game board 10, a first deck 12 of cards 14 identified as FACT cards, a second deck 16 of cards 18 identified as QUESTION cards, and a plurality of individual player tokens 20, 22, 24, and 26.

The layout of board 10 comprises a path made up of squares or boxes 28 extending from a START position indicated by an arrow 30 upwardly parallel to the left edge 32 of the board, across the top edge 34, down the right edge 36, across the bottom edge 38, upwardly alongside and parallel to the original leg of the path, across and parallel to the second leg of the path, and downwardly alongside and parallel to the third leg terminating in a box 40 marked WHAT HAVE YOU LEARNED? The path preferably includes 100 squares 28 with alternate ones having a "question mark" symbol displayed therein substantially as shown. Hence, there are 50 squares having the question mark symbol and 50 squares being blank. As will be more particularly pointed out, the squares 28 having the "question mark" symbol are associated with the QUESTION cards 18 of deck 16 which preferably also contains 50 cards bearing questions relating to illegal chemical substance abuse. Similarly, the alternate blank squares 28 are associated with the FACT cards 14 of deck 12 and here again, preferably, 50 such cards are provided. In accordance with the invention, the FACT cards bear facts about the hazards associated with illegal chemical substance abuse as will be more particularly described below.

In the upper section of game board 10 in the space circumscribed by the path of squares 28 is provided a rectangle 42 defining a space or zone for two side-by-side, smaller rectangles 44, 46, the former of which bears the legend FACTS, the latter of which bears the "question mark" symbol. The rectangle 44 defines space on the board 10 for positioning the deck 12 of FACT cards 14 whereas the rectangle 46 defines space on the board 10 for positioning the deck 16 of QUESTION cards 18 prior to commencing play.

Located below rectangle 42 in the lower section of game board 10 circumscribed by the path of squares 28 and substantially centrally thereof is provided a circle 48 divided into 6 pie-slice segments bearing in alternation the following labels: LOSE A TURN, FACT, QUESTION MARK, as best viewed in FIG. 5. Pivotally mounted on the central axis 50 of circle 48 is an arrow or pointer 52 adapted to be rotated or "spun" by any of the game players. Rotatable arrow 52 and segmented circle 48 comprise chance means for indicating the moves of player tokens 20, 22, 24, and 26 along the path of squares 28. Thus, for example, if the arrow is spun and stops on a circle segment marked FACT, a player will move one of the tokens (his or hers) to the first available square 28 associated with the FACT symbol (i.e. a "blank" square).

While any number of players may participate, it is preferred that no more than four (4) players attempt to play at a given time. The player tokens each have a different color as follows: token 20=white, token 22=blue, token 24=yellow, and token 26=green and this color assignment dictates the order of play as follows:

First to go=white
Second to go=blue
Third to go=yellow
Last to go=green

Prior to commencing play, the individual tokens are selected by the players by picking blind or at random. However, it will be understood that order of play may be selected using other means. For example, order of play may be selected by chance using a six-sided die with highest number going first, second highest going second, and so on. Or, a conventional deck of playing cards may be used with each player drawing a card to determine order of play (i.e. highest card goes first, second highest goes second, etc.). This would especially be appropriate if more than four players play at once (in which case additional player tokens must be employed). In such cases, color does not indicate order of play.

The rules of play of the game of the invention are relatively simple and easy to learn. The FACT cards and the QUESTION cards are placed on the game board in their assigned positions in spaces 44, 46, respectively, and the first-to-play player, i.e. the player with the white token 20 operates the chance means by spinning arrow 52 to determine the box or square 28 to which the player is to move his/her token. In the preferred embodiment, blank squares 28 correspond to FACT cards, whereas squares 28 having a "question mark" symbol correspond to QUESTION cards. Thus, for example, if the arrow 52 comes to rest on the segment labeled FACT, the token 20 is moved to the first blank box on the path, or the second box 28 counting from arrow 30. If the first player spins the arrow and it comes to rest on the segment marked by the QUESTION-MARK SYMBOL, the token 20 is moved to the first square 28 adjacent arrow 30 (i.e. the one with the "question-mark"). Finally, if the arrow comes to rest on the segment marked LOSE A TURN, the player's token 20 cannot be placed on any square, i.e. he/she loses a turn. The other players follow in assigned order and in the same manner to determine how their game pieces are moved along the path defined by squares 28.

When a token of any player is placed on a FACT or QUESTION square 28, the corresponding card 14 or 18 is drawn or selected from the top of the deck and read aloud to the other players. If it is a FACT card, a discussion of the FACT presented may be had before the next player's turn. If the selected card corresponds to a question-mark square (i.e. a QUESTION card is drawn) that player must attempt to answer the question on the card by giving his/her own opinion as to the correct answer. The other players may discuss the answer and decide if the player's response was correct. Play is continued until all four tokens have landed in the WHAT HAVE YOU LEARNED? box 40.

Once a card 14, 18 has been selected corresponding to the operation of chance means (arrow 52, circle 48) and movement of a token 20–26 to an appropriate square 28, that card may be retained by the individual player or returned to the bottom of each corresponding deck.

Moreover, if a player spins arrow 52 and it indicates movement to a box 28 already occupied by a player token, then the player whose turn it is must go to the next available box of the same character, i.e. 2 spaces from the occupied space.

The primary object of the present invention is to provide an enjoyable and challenging method and apparatus for teaching teenagers or adults the hazards and ill effects of using banned narcotics, illegal chemical substances and so on. People being rehabilitated from drug use will find that playing the game of the invention is particularly rewarding. By coupling this learning process to a game board context, in accordance with the principles of the present invention, learning and reinforcement of the SAY NO TO DRUGS message is rendered more efficient and effective. The antidrug message is shaped and given power by the nature of the indicia contained on the FACT cards 14 and the QUESTION cards 18. Without limiting the present invention, the FACT cards and QUESTION cards may carry the following exemplary statements:

TABLE 1-REPRESENTATIVE QUESTIONS ON QUESTION CARDS

1. What would you do if someone offered you some drugs?
2. Do any of your friends use drugs?
3. Have you ever used drugs?
4. How would you go about helping a loved one who used drugs?
5. If you ever used drugs before, what got you started?
6. Have you ever seen anyone use drugs before?
7. Who should we go after, a drug user, or the drug dealer, or both, and why?
8. Should everyone get involved in helping to stop drugs from coming into our neighborhoods? And why?
9. Should there be more prisons built, or more drug rehabilitation centers? Why?
10. Do you think that drugs affect one race more than another and which ones?
11. If you were a parent, how would you feel if someone gave your children drugs?
12. Why do you think people get involved in drug use?
13. Can you get drugs with anything other than money? How?
14. Do you have the right to refuse drugs?
15. Do you think you can catch AIDS by sharing hypodermic syringes, or using syringes used by someone else?

TABLE 2-REPRESENTATIVE FACTS ON FACT CARDS

1. It's a fact: AIDS can be transmitted to anyone through IV drug use, sexual contact, or contaminated blood.
2. It's a fact: Drug addicted women expecting a baby can pass physical or mental problems to their newborn.
3. It's a fact: No drug is free from toxic effects.
4. It's a fact: When a drug is taken repeatedly over a prolonged period of time, drug tolerance develops and larger and larger doses of the drug must be given in order to obtain the same therapeutic effect produced by the original small dose.
5. It's a fact: Cocaine can be injected or by sniffing it into the nostrils. The areas of injection often become infected, and when cocaine is sniffed, it gradually erodes the nasal septum and often causes the chronic cocaine sniffer to develop a perforated septum.
6. It's a fact: Cocaine is also a cell poison, and if it is present in an area for too long or in too high a concentration, it may harm cell tissues.
7. It's a fact: After discontinuing use of a drug, some users find it extremely difficult to function normally without using amphetamines. Many users who abruptly discontinue using amphetamines experience profound psychological depression, and continue using the drug to avoid this feeling.
8. It's a fact: Both amphetamines and cocaine, when taken by any route, are potentially toxic; some users become irritable and have a tendency to repeat certain behavior patterns, while others develop a psychotic syndrome characterized by delusions of persecution (paranoid ideation) and auditory or visual hallucinations.
9. It's a fact: "Delirium tremens" (also called D.T.'s) is a fit of involuntary shaking or quivering, a violent delirium with tremors that is induced by excessive or prolonged use of alcoholic beverages.
10. It's a fact: With chronic use, some tolerance develops to the behavioral and toxic effects of phencyclidine, and withdrawal may be accompanied by vague complaints about craving. Chronic users have reported speech, memory, and thinking impairments lasting as long as a year after stopping, and some researchers believe that it is likely that chronic PCP use induces some form of brain damage.
11. It's a fact: Phencyclidine has a number of street names: "PCP," or "peace pill," "hog" and "angle dust," it can be snorted, inhaled, or smoked, this route of administration gives the user greater control over the dose, and the use of phencyclidine, spreads rapidly. Although high doses of phencyclidine and related compounds produce hallucinations, the overall effects and the mechanisms of action are quite distinct from those of LSD and related psychedelics.
12. It's a fact: Cocaine addiction is one of the most difficult addictions to overcome, even with specialized hospital care.
13. It's a fact: Repeated administration of certain drugs causes profound changes in the central nervous system and leads to drug dependence. These drugs include opiates, barbiturates, amphetamines, alcohol, cocaine, and various mind altering agents. These drugs often lead to psychic dependence, that is a drive or craving that requires periodic administration of the drug for pleasure.
14. It's a fact: Certain drugs also produce physical dependence so that when the drug is no longer taken physical symptoms, known as a withdrawal syndrome, occur. Abrupt withdrawal of some central depressants—for example, the barbiturates, may produce effects so severe as to cause death.
15. It's a fact: If a drug user can't support his or her habit, they will seek crime or other means to support their drug addiction.

Although only a limited number of exemplary statements are shown for illustrative purposes, it will be appreciated that there are as many statements as there are FACT cards and QUESTION cards, respectively.

At the end of the game, i.e. when all player tokens 22–26 have landed in box 40, the players should then discuss what each has learned from listening to and discussing the various statements read from the FACT cards and the QUESTION cards and the personal opinions expressed by the players during the discussions following each selection of a card from their corresponding decks 12, 16. This will further reinforce the powerful learning experience engendered by participating in the game of the present invention.

Turning now to FIGS. 6–10 there is shown an alternative form of the invention where like reference numerals represent like parts. In the alternative form of the invention, a metallic plate 54 generally shaped to represent a human arm substantially as shown is affixed using suitable means (e.g. an adhesive) to the game board in the lower section of the board circumscribed by the path of squares 28. In this alternative embodiment the chance means comprising segmented circle 48 and arrow 52 are located to the right of the arm representation 54.

Figure 9:
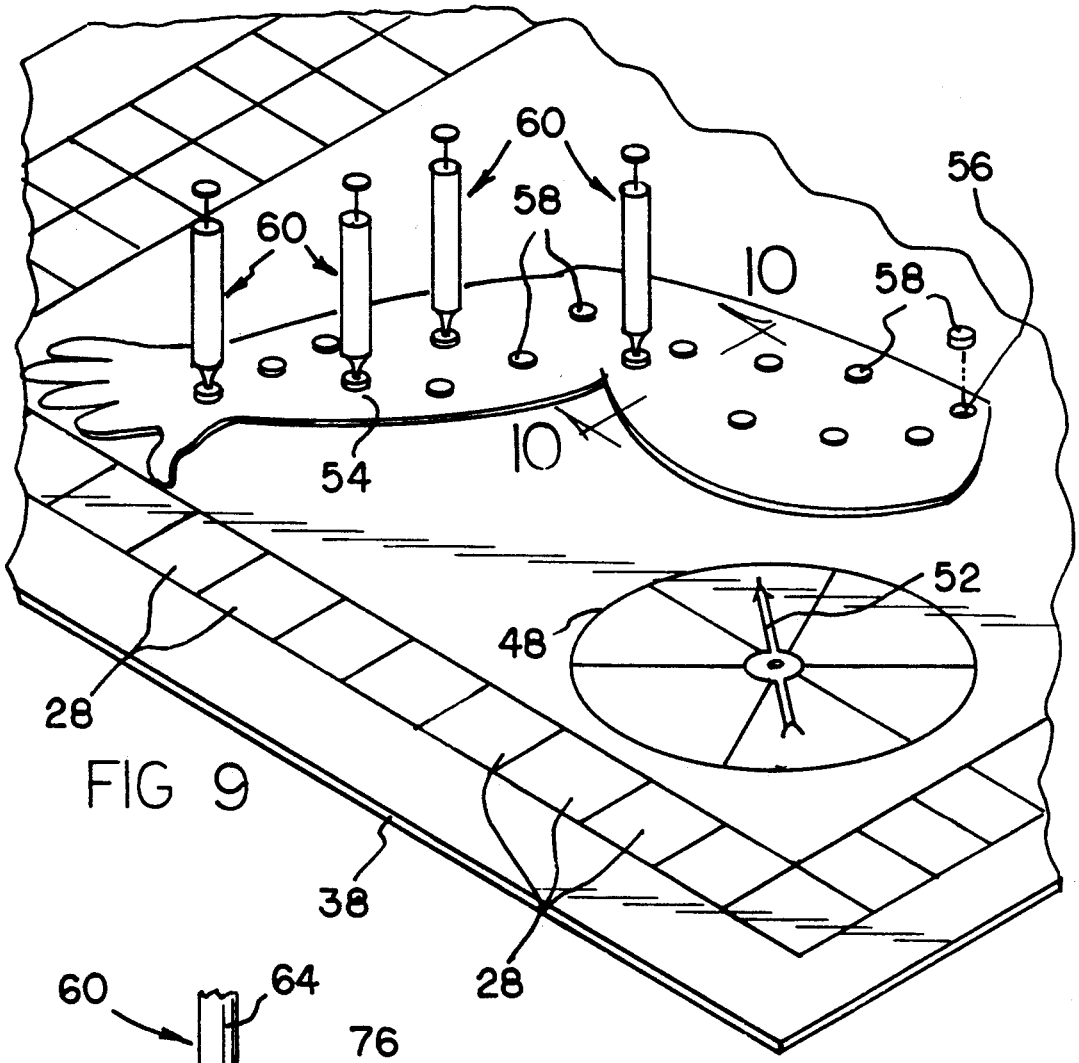
FIG. 9 is an enlarged perspective view of the game board embodiment of FIG. 6.
Figure 10:
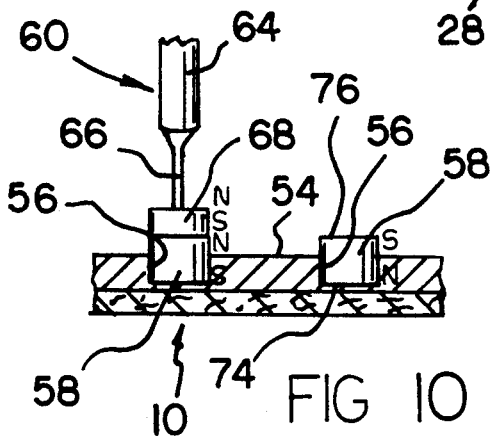
FIG. 10 is a cross-sectional view taken along line 10—10 of FIG. 9.

As best seen in FIGS. 9 and 10, a series of receptacles 56 preferably cylindrically shaped are provided in plate 54 with the number of such receptacles preferably being equal to the number of QUESTION cards 18 in deck 16. A disc shaped element 58 in the form of a permanent magnet having a north pole one side and a south pole on the other side is normally positioned in each receptacle 56 so as to be magnetically attracted to plate 54.

A series of game pieces generally represented by reference numeral 60 are provided in the shape of miniature hypodermic syringes substantially as shown in FIG. 8. Thus, each game piece 60 includes a top 62 simulating the plunger of the syringe, a central section 64 simulating the barrel portion of the syringe and a bottom section 66 simulating the needle portion of the syringe. Bottom section 66 terminates in a disc shaped permanent magnet element 68 having a polarity opposite to that of disc elements 58 when the latter normally are reposed or seated within receptacles 56. As a result of this arrangement, the magnetic element 68 will be attracted to the magnetic element 58 as depicted for example on the left side of FIG. 10. Hence, at the commencement of play of the alternative form of the board game according to the invention, the game pieces 60 representing hypodermic syringes are positioned on the game board in magnetic attraction to plate 54 via removable magnetic discs 58 (see FIGS. 6 and 9 also).

Under the rules of play of the alternative embodiment of FIGS. 6–10, a game piece 60 is removed from board 10 each time a player correctly answers a question on a selected QUESTION card. The game piece then is placed on a holding tray 70 having a surface 72 magnetically attracting to the magnetic element 68 on each piece 60. The disc element 58 corresponding to the removed game piece 60 is then removed from its receptacle 56, turned upside down and reinserted into its receptacle 56. This condition is shown on the right-hand side of FIG. 10. Preferably, the obverse side 74 of each disc 58 carries indicia associated with a QUESTION card, e.g. the number of that card; whereas the reverse side 76 carries indicia indicating a correct answer; e.g. a distinctive color such as "green," a "check mark," or whatever else may be desired to indicate success. In addition, because the magnetic polarity of disc element 58 is reversed when turned upside down, a game piece 60 and its magnetic disc element 68 will be repelled further providing an indication of a successful answer to a posed QUESTION card. To determine whether a question contained on a particular QUESTION card has been answered correctly, the other players merely vote after each answer is given by the player whose turn it is. Alternatively, a separate ANSWER key (not shown) listing the correct answers by number may be provided. Removal of the game pieces 60 simulating hypodermic syringes from the game board symbolizes overcoming a substance abuse habit and provides a strong reinforcing message to the players of the game.

It is apparent that by studying the "Rules" of the game of the present invention in conjunction with the disclosure of the game, as set forth above, many players will be able to experience the game of the invention in an enjoyable manner all of the while gaining important knowledge about the hazards and deleterious effects of chemical substance abuse.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing form the principles and concepts set forth. Hence, the proper scope of the present invention should be determined only by the broadest interpretation of the appended claims so as to encompass all such modifications and equivalents.

What is claimed as being new and desired to be protected by Letters Patent of the United States is as follows:

1. An educational board game for teaching the harmful effects of chemical substance abuse to a plurality of players, comprising:

a game board, said game board having a path designated thereon, said path comprising a series of spaces associated with FACT statements and QUESTIONS, respectively, said FACT statement spaces and said QUESTIONS spaces being disposed in alternating sequence in said path, a first series of cards containing indicia associated with said FACT statements, a second series of cad containing indicia associated with said QUESTIONS, a series of player tokens adapted for movement on said game board, and chance means operable by each of said players in turn to determine movement of said tokens on said board, whereby a player reads the indicia on a selected one of said FACT cards or on a selected one of said QUESTION cards when said chance means indicates movement of said player's token to a corresponding space on said board path, wherein said board contains first and second spaces for defining locations for said first and said second series of cards, respectively, wherein said indicia on said FACT cards comprises factual statements regarding chemical substance abuse, and wherein said indicia on said QUESTION cards comprises questions about chemical substance abuse, and wherein said chance means comprises a circle on said board, an indicator rotatable about the central axis of said circle, and segments dividing said circle, at least one of said segments being associated with said first series of cards, and at least another of said segments being associated with said second series of cards.

2. An educational board game for teaching the harmful effects of chemical substance abuse to a plurality of players, comprising:

a game board, said game board having a path designated thereon, said path comprising a series of spaces associated with FACT statements and QUESTIONS, respectively, a first series of cards containing indicia associated with said FACT statements, a second series of cad containing indicia associated with said QUESTIONS, a series of player tokens adapted for movement on said game board, and chance means operable by each of said players in turn to determine movement of said tokens on said board, whereby a player reads the indicia on a selected one of said FACT cards or on a selected one of said QUESTION cards when said chance means indicates movement of said player's token to a corresponding space on said board path, wherein said indicia on said FACT cards comprises factual statements regarding chemical substance abuse, and wherein said indicia on said QUESTION cards comprises questions about chemical substance abuse, said educational board game further comprising means for indicating when a question on a selected one of said QUESTION cards has been answered correctly by one of said players, said indicating means comprising a series of game pieces simulating hypodermic syringes, said indicating means including means for detachably affixing each of said game pieces to said game board, whereby at least one of said game pieces is detachably removed from said game board in response to a question on a corresponding QUESTION card being correctly answered.

3. The invention of claim 1 wherein said detachable affixing means comprises a plate on said game board, a series of receptacles provided in said plate corresponding to a different one of said questions on said QUESTION cards, respectively, first magnetic means disposed in each of said receptacles and wherein each of said game pieces includes second magnetic means respectively adapted to be attracted to said first magnetic means.

4. The invention of claim 3 wherein said first magnetic means comprises a magnetized disc adapted to be seated in one of said receptacles, said disc having a pair of opposed faces, one of said faces bearing indicia associated with a question on one of said QUESTION cards, the other of said opposed sides bearing indicia indicating a question has been correctly answered, whereby said one face on said magnetized disc faces upwardly from said plate and engages said first magnet means in one position of said disc in said receptacle, and said other face faces upwardly from said plate in another position of said disc in said receptacle.

5. The invention of claim 4 wherein said plate is in the shape of a human arm and the number of said receptacles in said series of receptacles equals the number of QUESTION cards on said second space on said board.

6. The invention of claim 5 wherein the number of spaces in said path on said board associated with said QUESTIONS is equal to the number of QUESTION cards on said second space on said board.

7. The invention of claim 6 wherein the spaces in said path on said board associated with said FACT statements alternate with said spaces in said path on said board associated with said QUESTIONS.

8. The method of teaching a group of individuals the hazards of chemical substance abuse comprising the steps of:

providing a game board having a path thereon, said path having individual spaces associated with FACT statements and QUESTIONS regarding chemical substance abuse, providing a series of player tokens for each player in said group respectively, providing chance means manipulatable for indicating the space on said path each player is to move his/her token, providing first and second series of cards containing said FACT statements and said QUESTIONS, respectively, having each player manipulate said chance means, in turn, to indicate a space on said board path to which said player moves his/her token, having each player, in turn, read to the other players a card corresponding to the space on said board path to which that player's token has been moved, and having each player, in turn, attempt to answer the question posed by a QUESTION card should said manipulation of said chance means indicate movement of that player's token to a space on said board associated with a QUESTION.

9. The method of claim 8 further comprising the step of:

providing manipulatable means on said board for indicating that an answer has correctly been given to said posed question on said QUESTION card, and having said player manipulate said means for indicating in response to that player giving said correct answer.

10. The method of claim 9 wherein said indicating means comprises a series of game pieces detachably affixed to said game board in a predetermined location, said game pieces simulating hypodermic syringes, and said method step of manipulating said indicating means comprises the steps of:

i) detachably removing one of said simulated hypodermic syringes from said predetermined location on said board, and ii) placing said removed simulated hypodermic syringe on a tray displaced from said game board, and iii) changing the nature of the location from which said simulated hypodermic syringe had been detachably removed to indicate a correct answer had been given to the question corresponding to said location.

* * * * *